US005145064A

United States Patent [19]

Chen

[11] Patent Number: 5,145,064

[45] Date of Patent: Sep. 8, 1992

[54] DOUBLE-MATCHED TOOL BOX

[76] Inventor: Kuen-Jenn Chen, No. 6, Lane 609, Sec. 1, Chung Shan Rd., Ta Chia Chen, Taichung Hsien, Taiwan

[21] Appl. No.: 671,320

[22] Filed: Mar. 19, 1991

[51] Int. Cl.[5] ..... B65D 85/00

[52] U.S. Cl. ..... 206/372; 206/373; 206/45.11; 220/335

[58] Field of Search ..... 206/372, 373, 374, 375, 206/376, 377, 378, 45.11, 45.13, 45.18; 220/4.27, 4.26, 509, 501; 190/115; 312/DIG. 33

[56] References Cited

U.S. PATENT DOCUMENTS

| | | | |
|---|---|---|---|
| 294,938 | 3/1884 | Traver | 206/45.11 |
| 684,711 | 10/1901 | Palmer | 206/45.11 |
| 1,274,003 | 7/1918 | Christie | 190/115 X |
| 2,466,552 | 4/1949 | McCarty | 206/373 X |
| 4,156,480 | 5/1979 | Darbonnier | 190/115 X |
| 4,240,222 | 12/1980 | Covington | 312/33 X |
| 4,285,556 | 8/1981 | Loeffel | 312/33 X |
| 4,288,011 | 9/1981 | Grossman | 312/33 X |
| 4,951,812 | 8/1990 | Chen | 206/373 X |
| 4,998,616 | 3/1991 | Hillinger | 206/372 X |
| 5,069,342 | 12/1991 | Dickinson | 312/33 X |

FOREIGN PATENT DOCUMENTS

| | | | |
|---|---|---|---|
| 0103974 | 2/1917 | Fed. Rep. of Germany | 206/373 |
| 1471571 | 3/1967 | France | 206/45.11 |

*Primary Examiner*—Paul T. Sewell
*Assistant Examiner*—Ted Kavanaugh
*Attorney, Agent, or Firm*—Varndell Legal Group

[57] ABSTRACT

A double-matched tool box, comprising two unit tool boxes attached together side by side through tongue and groove joint. Each unit tool box has a hand-hold portion for the purpose of hand carrying and is comprised of two hinged compartments having a plurality of tool storage holes symmetrically made at the inside. The two unit tool boxes can be attached together for use as a solid tool box or separated from each other for use as two independent tool boxes.

2 Claims, 4 Drawing Sheets

DOUBLE-MATCHED TOOL BOX

BACKGROUND OF THE INVENTION

The present invention relates to tool boxes and relates more particularly to a double-matched tool box which is comprised of two face-matched unit chests that can be each separately used as an independent tool box.

Conventionally, a tool box is generally comprised of a box that is more or less rigid and rectangular and that opens into two hinged compartments having grooves symmetrically made at the inside for keeping tools. In this structure of tool box, only limited space is provided for keeping limited amount of tools. For holding more tools, the length and width of the two hinged compartments must be increased. However, extended size of the two hinged compartments causes the tool box inconvenient to carry.

In U.S. Pat. No. 4,951,812 there is disclosed a structure of tool case which is comprised of a plurality pairs of casings connected in series that can be folded up into shape with one of each pair of casings face-matched with the other of each pair of casings. This structure of tool case occupies less space but provides such compartments for keeping more tools. However, because the casings are not detachable, they must be all carried together all the time even if when less tools are kept therein.

SUMMARY OF THE INVENTION

The present invention has been accomplished to eliminate the aforesaid problems. According to a first aspect of the present invention, there is provided a tool box which is comprised of two unit tool boxes that are face-matched through tongue and groove joint and that can be separated from each other for use as an independent tool box each.

According to a second aspect of the present invention, there is provided a tool box which is comprised of two face-matched unit tool boxes that can be separated from each other for use as an independent tool box each, wherein each unit tool box is comprised of two hinged compartments and has three unitary, raised blocks at the outside respectively disposed at triangular locations for supporting each unit tool box in a standing position.

According to a third aspect of the present invention, there is provided a tool box which is comprised of two face-matched unit tool boxes that can be separated from each other for use as an independent tool box each, wherein each unit tool box is comprised of two hinged compartments that are connected together through a triangle connecting bar. Because of the triangle connecting bar, when one compartment of either unit tool box lies open on the ground or a flat surface, the other compartment of said unit tool box can still be supported in a standing position.

DETAILED DESCRIPTION OF THE PREFERRED EMBODIMENT

Figure 1:
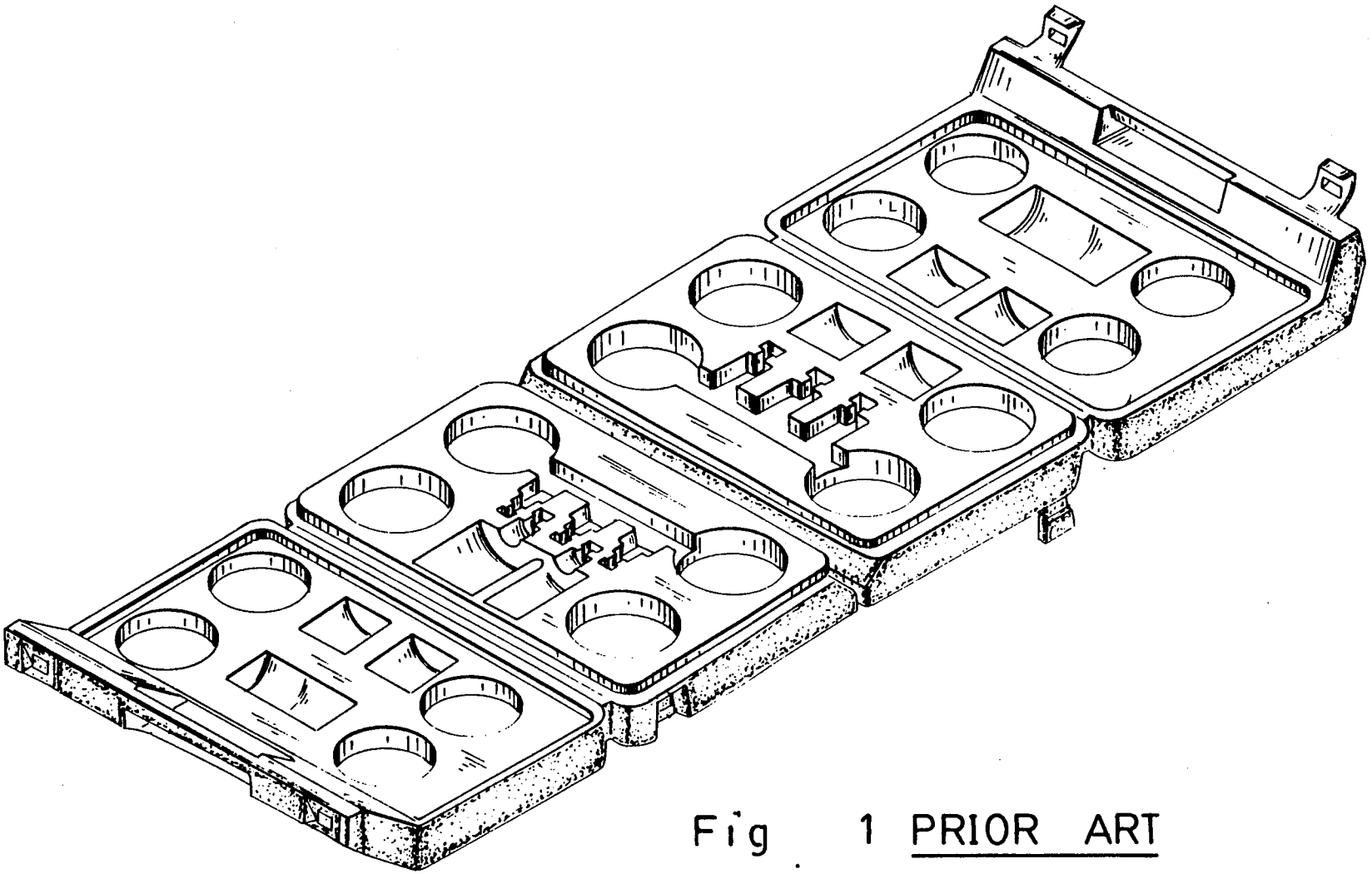
Fig. 1 PRIOR ART
FIG. 1 illustrates the tool case disclosed in U.S. Pat. No. 4,951,812.
Figure 2:
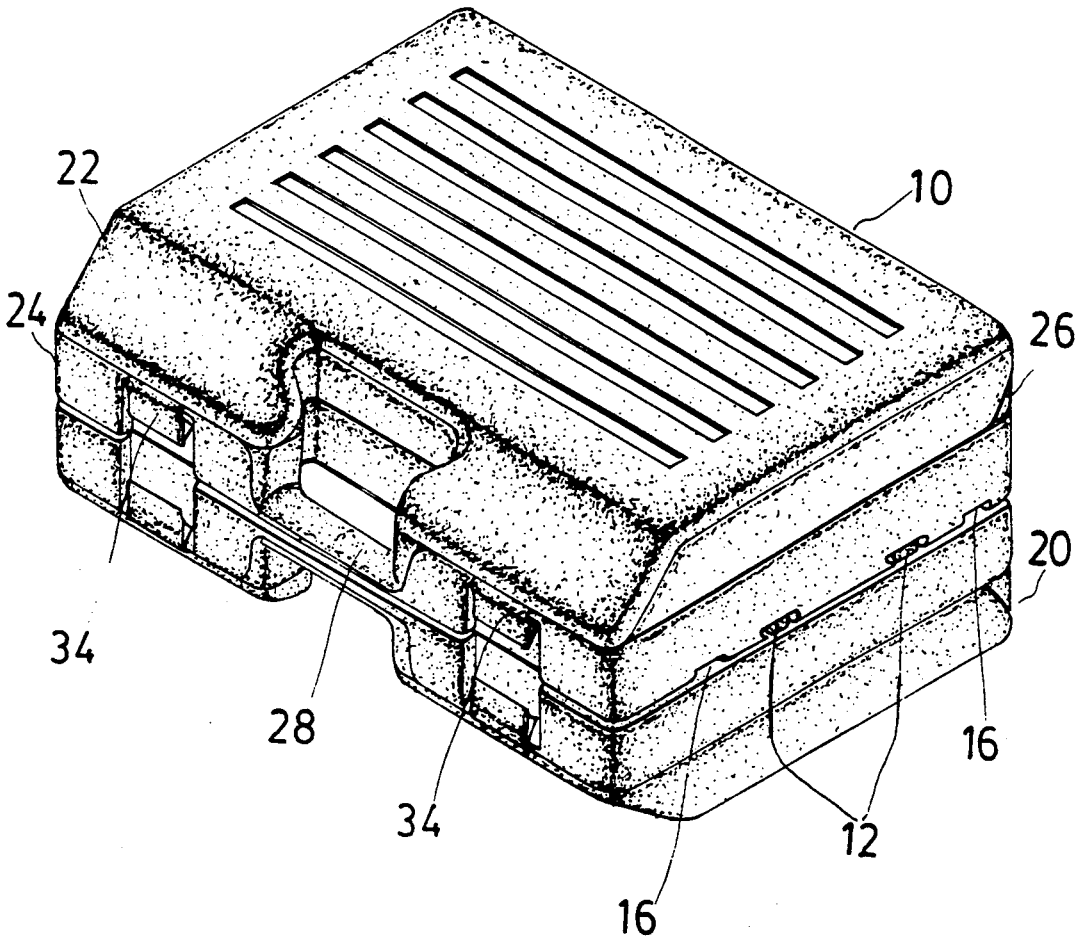
FIG. 2 illustrates the outer appearance of the preferred embodiment of the tool box of the present invention.

Referring to FIG. 2, a tool box in accordance with the present invention is generally comprised of two unit tool boxes 10 and 20 that are face attached through tongue and groove joint.

Figure 3:
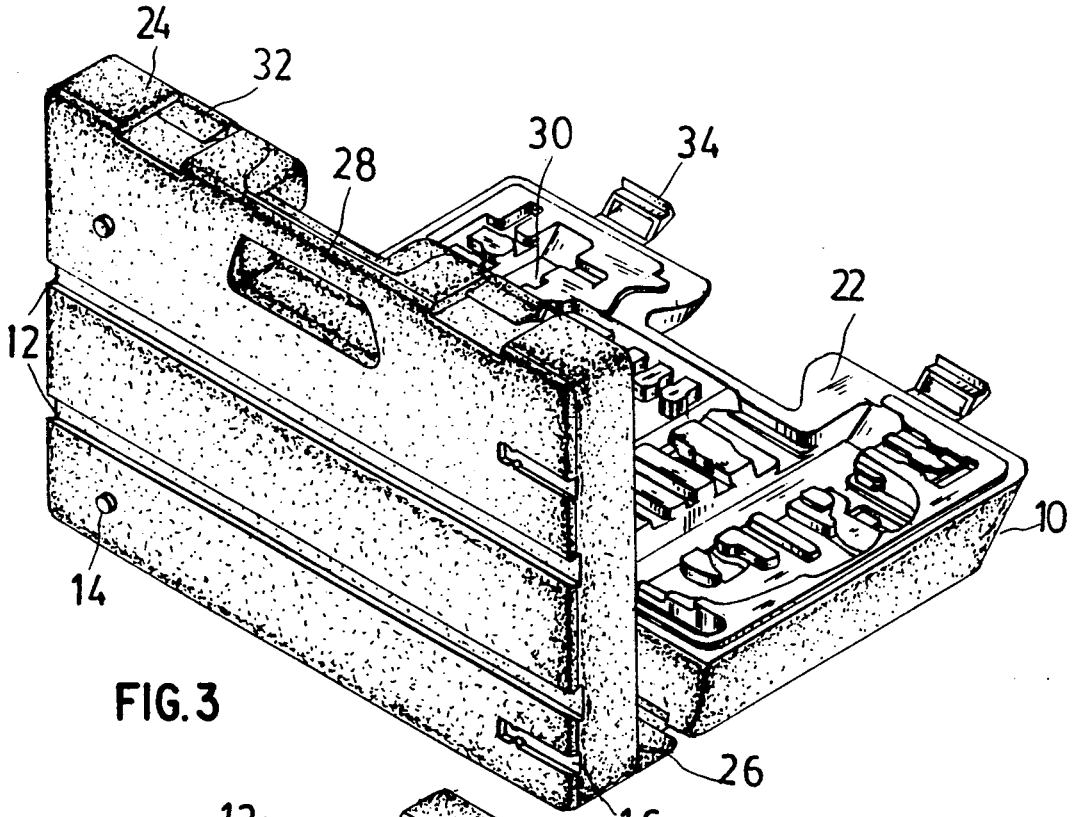
FIG. 3 and 3A illustrates that the two unit tool boxes of the preferred embodiment of the tool box of the present invention are separated from each other wherein one is opened into two hinged compartments and the other is in a closed condition.
Figure 3A:
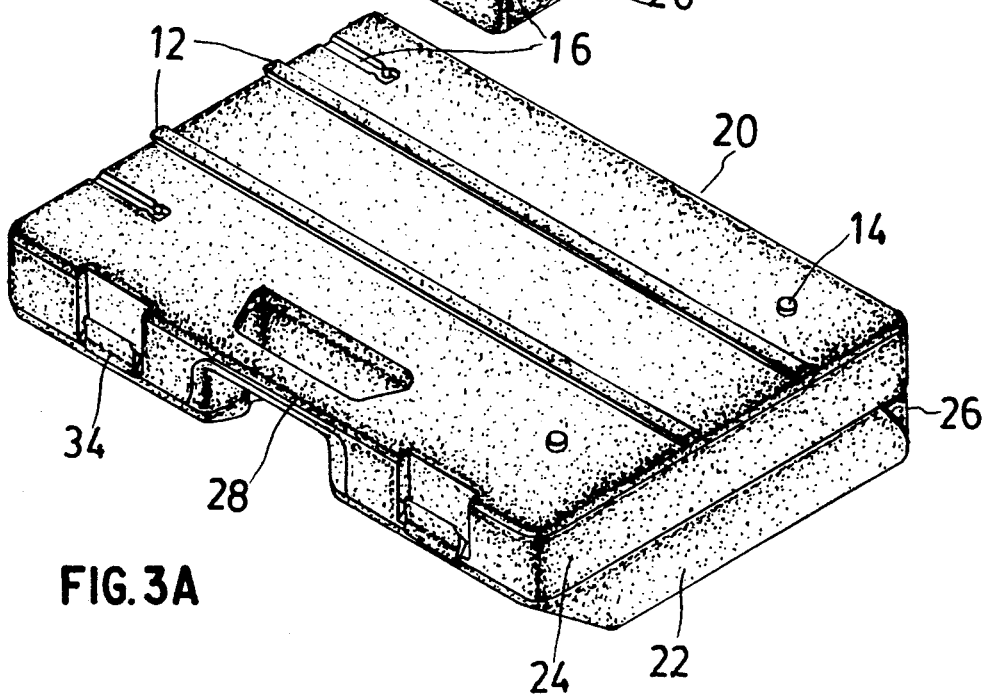

Referring to FIG. 3 and 3A dovetail tongues 12 and dovetail grooves 13 are alternatively made on the two unit tool boxes 10 and 20 of the tool box for connection. Retaining grooves 16 and stub pegs 14 are symmetrically made on each unit tool box so that the retaining grooves 16 and the stub pegs 14 on one unit tool box 10 or 20 are respectively engaged with the stub pegs 14 and the retaining grooves 16 of the other unit tool box 20 or 10 to firmly secure the two unit boxes 10 and 20 in position when the two unit tool boxes 10 and 20 are face matched by engaging the dovetail tongues 12 in the dovetail grooves 13.

Referring to FIG. 3 and 3A again, each unit tool box 10 or 20 is comprised of two hinged compartments, namely an upper compartment 22 and a lower compartment 24 which are connected together through a triangle connecting bar 26 and which have each a plurality of tool storage holes 30 symmetrically made at the inside for keeping tools. Further, the lower compartment 24 of each unit tool box 10 or 20 has a hand-hold portion 28 at one side opposite to the triangle connecting bar 26, and two retaining notches 32 at two opposite locations relative to said and-hold portion 28; the upper compartment 22 of each unit tool box 10 or 20 has two snap fasteners 34 at two opposite locations corresponding to the two retaining notches 32 on the lower compartment 24. When the two compartments 24 and 26 are closed together, the snap fasteners 34 are respectively fastened in the retaining notches 32 to firmly secure the unit tool case 10 or 20 in a closed condition. Through the hand-hold portion 28, the unit tool box 10 or 20 can be conveniently carried with the hand.

Figure 4:
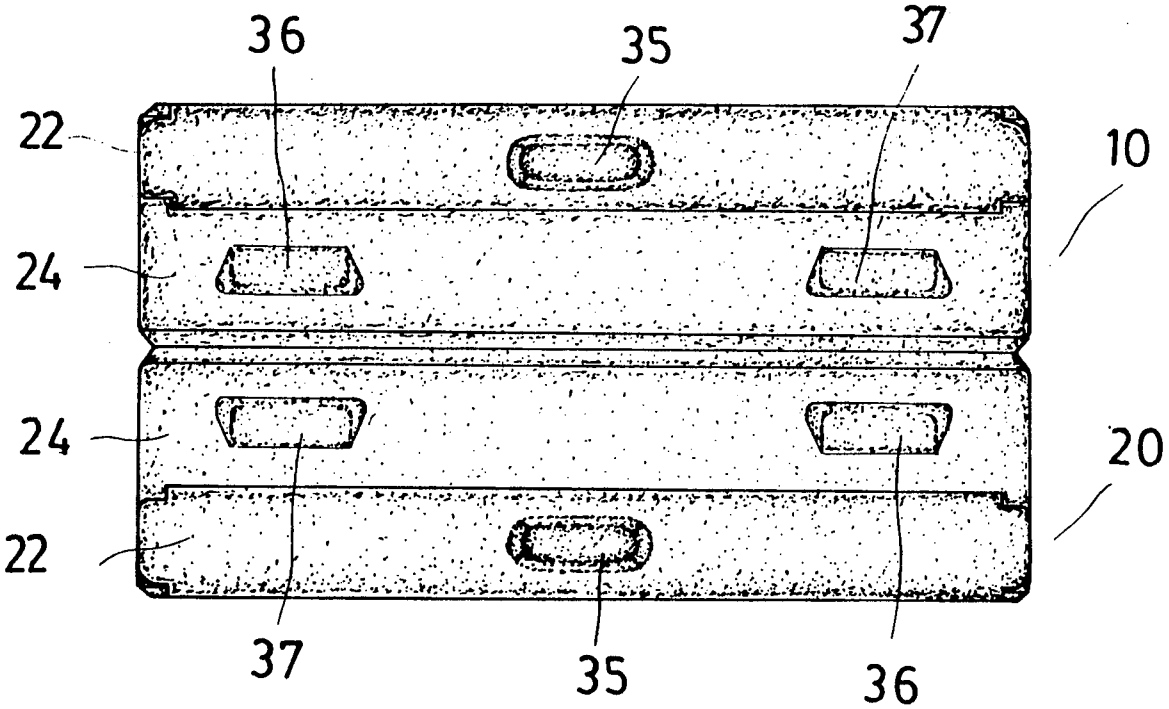
FIG. 4 is a bottom view of the preferred embodiment of the tool box of the present invention.

Referring to FIG. 4, each unit tool box 10 or 20 has three unitary, raised blocks 35, 36 and 37 on the outer wall thereof at one side opposite to the hand-hold portion 28 and respectively disposed at triangular locations, wherein raised block 35 is made on the upper compartment 22 at a middle position relative to the other raised two blocks 36 and 37 which are made on the lower compartment 24 at two opposite locations. By means of the raised blocks 35, 36 and 37, the unit tool box 10 or 20 can be separately supported in a standing position.

Please refer to FIG. 3 and 3A once again. In the present preferred embodiment, the triangle connecting bar 26 is formed of the bottom edge of the upper compartment 22 on which the raised block 35 is made. Therefore, when the upper compartment lies open on the ground or a flat surface, the lower compartment can still be supported by the three raised blocks 35, 36 and 37 in a standing position.

As disclosed, the two unit tool boxes 10 and 20 can be attached together for use as a unitary tool box or separated from each other for use as two independent tool boxes. Further, the storage holes in the two hinged compartments may be variously embodied in shape as well in size as required.

I claim:

1. A double-matched tool box for keeping tools, the improvement comprising two face-matched unit tool boxes respectively releasably connected through a tongue and groove joint, said unit tool boxes being each comprised of two hinged compartments connected through a unitary triangle connecting bar and defining therein a plurality of tool storage holes, said two hinged compartments including one having a hand-hold portion for carrying purpose and two retaining notches, and the other having two fastening means releasably fastened in said two retaining notches to firmly secure said two hinged compartments in a closed condition, and wherein said two unit tool boxes can be separated from each other for use as an independent tool box each.

2. The double-matched tool box of claim 1, wherein said triangle connecting bar is formed by cut portion of said upper compartment so that said upper compartment can be rotated through 90° angle relative to said triangle connecting bar when said lower compartment is kept in a standing position.

* * * * *